US010161685B2

(12) United States Patent
Voorhis, Jr. et al.

(10) Patent No.: US 10,161,685 B2
(45) Date of Patent: Dec. 25, 2018

(54) HEAT EXCHANGER WITH PARTITIONED INLET HEADER FOR ENHANCED FLOW DISTRIBUTION AND REFRIGERATION SYSTEM USING THE HEAT EXCHANGER

(71) Applicant: TRANE INTERNATIONAL INC., Davidson, NC (US)

(72) Inventors: Roger J. Voorhis, Jr., Clarksville, TN (US); Jun Wang, Clarksville, TN (US); Brian Westfall, Elgin, SC (US); Sean A. Smith, Chapmansboro, TN (US); Tao Zhou, Onalaska, WI (US); William B. Fox, Onalaska, WI (US); Felix Quintero, Columbia, SC (US); Michael W. Groen, La Crosse, WI (US); Justin S. Winters, Adams, TN (US); Robert F. Schult, Clarksville, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 76 days.

(21) Appl. No.: 14/992,636

(22) Filed: Jan. 11, 2016

(65) Prior Publication Data

US 2016/0201990 A1 Jul. 14, 2016

Related U.S. Application Data

(60) Provisional application No. 62/101,549, filed on Jan. 9, 2015.

(51) Int. Cl.
*F28D 1/053* (2006.01)
*F28F 9/02* (2006.01)

(52) U.S. Cl.
CPC ..... *F28D 1/05316* (2013.01); *F28D 1/05391* (2013.01); *F28F 9/026* (2013.01);
(Continued)

(58) Field of Classification Search
CPC ..... F28D 1/05316; F28D 1/05333; F28D 1/05341; F28D 1/05391; F28D 1/05383;
(Continued)

(56) References Cited

U.S. PATENT DOCUMENTS 4,236,381 A * 12/1980 Imral ..... F25B 13/00 62/324.1
5,157,944 A * 10/1992 Hughes ..... F25B 39/028 165/139

(Continued)

FOREIGN PATENT DOCUMENTS

JP 2001255039 A * 9/2001 ..... F25B 39/02

OTHER PUBLICATIONS

JP2001255039A—Machine English Translation.*

*Primary Examiner* — Orlando E Aviles Bosques
*Assistant Examiner* — Jose O Class-Quinones
(74) *Attorney, Agent, or Firm* — Hamre, Schumann, Mueller & Larson, P.C.

(57) ABSTRACT

Embodiments of a heat exchanger, e.g. a micro-channel heat exchanger are disclosed. The heat exchanger may include a plurality of rows of micro-channel tubes, each of which can be configured to direct a working fluid in a specific direction. The heat exchanger may include one or more distributors in a distribution header of the heat exchanger, each of which can be connected to a different application circuit (e.g. a refrigeration circuit) so that a capacity of the heat exchanger may be regulated. The heat exchanger as disclosed herein can be used as an evaporator and/or a condenser in a refrigeration system.

19 Claims, 14 Drawing Sheets

(52) U.S. Cl.
CPC ..... *F28F 9/0214* (2013.01); *F28F 9/0273* (2013.01); *F28F 2260/02* (2013.01)

(58) Field of Classification Search
CPC .... F28D 1/0408; F28D 1/0417; F28F 9/0214; F28F 9/0217; F28F 9/0273; F28F 9/0278; F28F 9/026; F28F 2260/02; F28F 17/005; F28F 2210/04; F28F 9/0202; F28F 9/0246; F28F 9/0204; F28F 2009/224; F28F 9/0234; F28F 9/0256; F28F 9/0268; F28F 9/0275; F25B 25/00; F25B 25/005
See application file for complete search history.

(56) References Cited

U.S. PATENT DOCUMENTS 5,174,373 A * 12/1992 Shinmura ..... F28D 1/05391 165/102
5,941,303 A * 8/1999 Gowan ..... F28D 1/05383 165/140
7,914,698 B2 3/2011 Minor et al.
2004/0159121 A1* 8/2004 Horiuchi ..... F25B 39/02 62/526
2008/0092587 A1* 4/2008 Gorbounov ..... F25B 39/028 62/498
2010/0012307 A1* 1/2010 Taras ..... F28D 1/0471 165/177
2011/0203308 A1* 8/2011 Chiang ..... F28F 9/0273 62/498
2011/0247791 A1 10/2011 Jiang et al.
2012/0103581 A1* 5/2012 Seo ..... F28D 1/05391 165/173
2014/0096944 A1* 4/2014 Seo ..... F28F 9/0204 165/174
2014/0245777 A1* 9/2014 Katoh ..... F28F 9/0204 62/515

* cited by examiner

HEAT EXCHANGER WITH PARTITIONED INLET HEADER FOR ENHANCED FLOW DISTRIBUTION AND REFRIGERATION SYSTEM USING THE HEAT EXCHANGER

FIELD

The disclosure herein relates to a heat exchanger, which may be used, for example, in a heating, venting, and air conditioning (HVAC) system. Systems, methods and apparatuses directed to the heat exchanger are disclosed.

BACKGROUND

A heat exchanger typically is configured to facilitate heat exchange between a first fluid (such as refrigerant and a process fluid, e.g. water) and a second fluid (such as air). A heat exchanger can be used, for example, in a HVAC system as a condenser and/or an evaporator. Various types of heat exchangers have been developed to work as a condenser and/or an evaporator. One type of heat exchanger is a micro-channel heat exchanger (MCHEX). A typical MCHEX may include micro-channel tubes running in parallel between two headers. The adjacent tubes generally have fan-fold fins brazed between the tubes. The micro-channel tubes form fluid communication with the headers. Refrigerant can be distributed into the micro-channel tubes from the headers, and/or collected in the headers when the refrigerant flows out of the micro-channel tubes. Outer surfaces of the micro-channel tubes and the fins may help heat exchange between the first fluid (such as refrigerant) in the micro-channel tubes and a second fluid (such as air) flowing across the outer surfaces of the micro-channel tubes.

SUMMARY

Embodiments of a heat exchanger, e.g. a micro-channel heat exchanger are disclosed.

In some embodiments, the heat exchanger may include a first header that includes a first chamber and a second chamber, and a second header. The heat exchanger may include a first heat exchange tube configured to connect the first chamber and the second header, and a second heat exchange tube configured to connect the second chamber and the second header.

In some embodiments, the heat exchanger may include a working fluid flow path formed from the first chamber to the first heat exchange tube, then to the second header, then to the second heat exchange tube.

In some embodiments, the first chamber may be configured to receive a working fluid, and the second chamber is configured to direct the working fluid out of the first header.

In some embodiments, the heat exchanger may be a micro-channel heat exchanger.

In some embodiments, the first chamber may be partitioned into at least two compartments, wherein one or more of the at least two compartments is configured to receive a working fluid.

In some embodiments, one or more of the at least two compartments may be configured to have at least one orifice to meter the working fluid.

It will be appreciated that any of the heat exchangers herein may include one or more refrigerant expansion devices, such as but not limited to one or more orifices.

In some embodiments, a heat exchanger may include a first header, a working fluid line, a second header, and a heat exchange tube connecting the first header and the second header. In some embodiments, the working fluid line may be connected to the first header externally.

In some embodiments, the working fluid line may be an inlet configured to receive a working fluid. In some embodiments, the heat exchanger may include a second working fluid line connected to the first header externally. In some embodiments, the second working fluid line may be configured to receive the working fluid.

In some embodiments, a heat exchanger may include a plurality of first tubes configured to direct a working fluid in a first direction, and a plurality of second tubes configured to direct the working fluid in a second direction.

In some embodiments, a heat exchanger may include a fluid drainage channel at an end of the heat exchanger. In some embodiments, the heat exchanger may include a fluid drainage channel positioned between a first portion of the heat exchanger and a second portion of the heat exchanger.

In some embodiments, the first portion of the heat exchanger may include a plurality of first heat exchange tubes directing a working fluid in a first direction, and the second portion of the heat exchanger may include a plurality of second heat exchange tubes directing the working fluid in a second direction.

In some embodiments, a refrigeration system may include a first circuit, a second circuit, and a heat exchanger that may include a first inlet, a second inlet, and a header. In some embodiments, the first inlet and second inlet may be configured to direct a working fluid into the header, where the first inlet may be configured to receive the working fluid to the first circuit, and the second inlet may be configured to receive the working fluid from the second circuit.

In some embodiments, a refrigeration system may include a heat exchanger that may include a first inlet, a second inlet, and a header. In some embodiments, the first inlet and second inlet may be configured to direct a working fluid into the header, and the first inlet may be configured to include a flow control valve.

In some embodiments, the heat exchanger as disclosed herein may be an evaporator of the refrigeration system. In some embodiments, the heat exchanger as disclosed herein may be a condenser of the refrigeration system, e.g. an air or water cooled condenser.

Other features and aspects of the systems, methods, and control concepts will become apparent by consideration of the following detailed description and accompanying drawings.

BRIEF DESCRIPTION OF THE DRAWINGS

Reference is now made to the drawings in which like reference numbers represent corresponding parts throughout.

FIG. 1A is a perspective view. FIG. 1B is an end view.

FIG. 2A is a cross section view. FIG. 2B illustrates a perspective view showing an internal configuration of a header of the heat exchanger.

FIG. 5A is an end view of the header that includes two external inlets. FIG. 5B illustrates a section view of the header in FIG. 5A. FIG. 5C illustrates another configuration of the header that includes one external inlet.

FIG. 6A is a perspective view of the heat exchanger. FIG. 6B illustrates a tube making system to make the heat exchanger by a folding process. FIG. 6C illustrates another embodiment of a stamping apparatus for the apparatus in FIG. 6B. FIG. 6D is a cross section view of a heat exchanger that can be made by the apparatus in FIG. 6B.

FIG. 7A illustrates a perspective view of the heat exchange tube. FIG. 7B illustrates a cross section view of the heat exchanger with two heat exchange tubes as illustrated in FIG. 7A.

FIG. 8A is a schematic view of the heat exchanger. FIG. 8B is a cross section view of a header of the heat exchanger.

DETAILED DESCRIPTION

Heat exchangers (e.g. MCHEX) may be used in various applications, such as for example in a HVAC system, to help establish a heat exchange relationship between a first fluid (such as a working fluid, e.g. refrigerant) and a second fluid (such as a process fluid, e.g. air and/or water).

This disclosure is directed to embodiments of a heat exchanger, e.g. a MCHEX. In some embodiments, the heat exchanger may include a plurality of rows of micro-channel tubes. Each row may be configured to direct a fluid flow in a specific direction. This may enable a more compact heat exchanger design with higher efficiency. In some embodiments, the heat exchanger may include one or more distributors in a distribution header of the heat exchanger, which allows, for example, the distributors to be connected to a different application circuit (e.g. a refrigeration circuit) so that capacity of the heat exchanger may be regulated. In some embodiments, a method of making a MCHEX is disclosed. In some embodiments, a method of using the heat exchanger is disclosed. In some embodiments, a system (e.g. a HVAC system) that includes the heat exchanger as disclosed herein and a method of controlling the system thereof is disclosed.

References are made to the accompanying drawings that form a part hereof, and in which is shown by way of illustration of the embodiments in which the embodiments may be practiced. It is to be understood that the terms used herein are for the purpose of describing the figures and embodiments and should not be regarded as limited in scope.

It is to be noted that the drawings herein may include an exemplary MCHEX and/or a HVAC system. However, the embodiments as disclosed herein may be applicable to other suitable heat exchangers, refrigeration and/or heat pump systems, and/or methods.

Figure 1B:
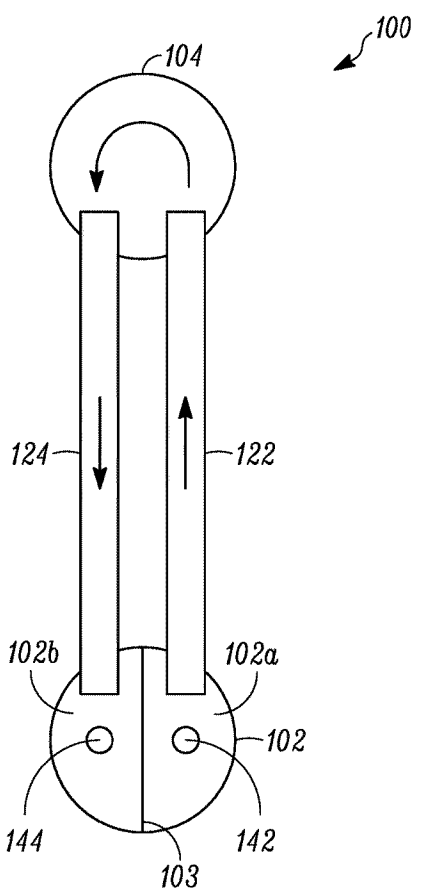
FIGS. 1A and 1B illustrate a heat exchanger according to one embodiment of this disclosure.
Figure 1A:
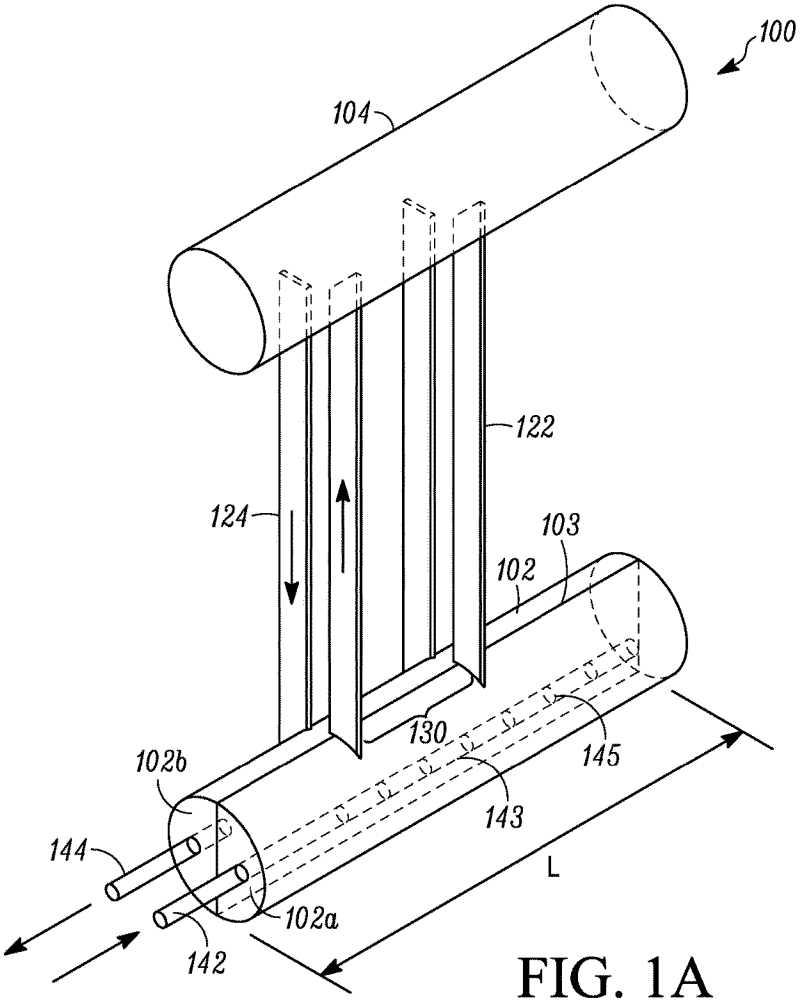

FIGS. 1A and 1B illustrate a heat exchanger 100. It is to be noted that for the purpose of illustration, some components of the heat exchanger 100, such as for example fins, are omitted from the drawings.

The heat exchanger 100 includes a first header 102 and a second header 104, where the first header 102 is partitioned into two compartments by a divider 103, e.g. an inlet chamber 102*a* and an outlet chamber 102*b*. The divider 103 generally blocks a fluid communication between the inlet chamber 102*a* and the outlet chamber 102*b*. When in use, the inlet chamber 102*a* is configured to receive a working fluid (e.g. a refrigerant), and the outlet chamber 102*b* is configured to direct the working fluid out of the first header 102.

A plurality of inlet heat exchange tubes 122 are arranged along a longitudinal direction L of the first header 102 (or the second header 104), and form a fluid communication between the inlet chamber 102*b* and the second header 104. When in use, the working fluid received by the inlet chamber 102*a* may be directed to the second header 104 through the plurality of inlet heat exchange tubes 122.

A plurality of outlet heat exchange tubes 124 are arranged along the longitudinal direction L of the first header 102 (or the second header 104), and form a fluid communication between the outlet chamber 102*b* and the second header 104. When in use, the working fluid in the second header 104 can be directed to the outlet chamber 102*b* through the outlet heat exchange tubes 124.

In the illustrated embodiment of FIGS. 1A and 1B, the inlet heat exchange tubes 122 may be aligned with the outlet heat exchange tubes 124 in the longitudinal direction L, which allows airflow to pass through a space(s) 130 between two neighboring heat exchange tubes relative to the longitudinal direction L. It is to be noted that in some embodiments, the inlet heat exchange tubes 122 may be offset relative to the outlet heat exchange tubes 124 in the longitudinal direction L.

A working fluid passage is formed from the inlet chamber 102*a* of the first header 102 to the second header 104 through the inlet heat exchange tube 122, then to the outlet heat exchange tube 124, and then to the outlet chamber 102*b* of the first header 102. In operation, the working fluid may be directed into the working fluid passage.

As illustrated, the working fluid can be directed into the inlet chamber 102*a* through an inlet 142. In the illustrated embodiment, the inlet 142 includes a tube 143 extending in the longitudinal direction L inside the inlet chamber 102*a*, and the tube 143 includes one or more orifices 145 configured to allow the working fluid to be distributed in the inlet chamber 102*a*. It is to be understood that the inlet 142 may have other configurations suitably configured to achieve a desired distribution of working fluid in the inlet chamber 102*a*.

The working fluid can enter the inlet heat exchange tubes 122 in the inlet chamber 102*a*, and be directed toward the second header 104. The working fluid can then enter the outlet heat exchange tubes 124 in the second header 104, and be directed toward the outlet chamber 102*b*. The working fluid can then be directed out of the outlet chamber 102*b* through an outlet 144.

It is to be appreciated that in some embodiments, the inlet heat exchange tubes 122 and the outlet heat exchange tubes 124 may be micro-channel tubes, with the understanding that microchannel tubes may not be used and that other suitable configurations and/or designs may be used.

In the illustrated embodiments, the first header 102 is partitioned into two compartments, the inlet chamber 102*a* and the outlet chamber 102*b*. This creates a two-pass working fluid passage design or a two-row heat exchange tubes design. It is also appreciated that in some embodiments, the first header 102 may be partitioned to more than two compartments, where each of the compartments may form a fluid communication with a row of heat exchange tubes, creating a multiple pass (e.g. more than 2) working fluid passage heat exchange tubes design. In some embodiments, both of the first header 102 and the second header 104 may be partitioned to more than one compartment.

The embodiments as disclosed herein generally are configured to include a plurality of rows of heat exchange tubes (e.g. the row of inlet heat exchange tubes 122, and the row of the outlet heat exchange tubes 124) that extend between two headers (e.g. the first header 102 and the second header 104). The heat exchange tubes may form fluid communication between the two headers. Each or both of the headers may include one or more separated compartments (e.g. the inlet chamber 102*a* and the outlet chamber 102*b*), where each of the separated compartments may be configured to serve a desired function, e.g. directing a working fluid into the header or out of the header so that one header may serve more than one function, which may include, for example, receiving a working fluid, directing a working fluid, distributing a working fluid, collecting a working fluid, and/or releasing a working fluid. The embodiments as disclosed herein therefore allow different functions to be provided in a relatively compact heat exchanger design (e.g. a heat exchanger only has two headers), which may help achieve a higher efficiency when the heat exchanger is used in a system (e.g. a HVAC system). The embodiments as disclosed herein may be used to modify a component of a conventional heat exchanger and enables multiple rows of heat exchange tubes to be incorporated into a single heat exchange tube section.

Figure 2A:
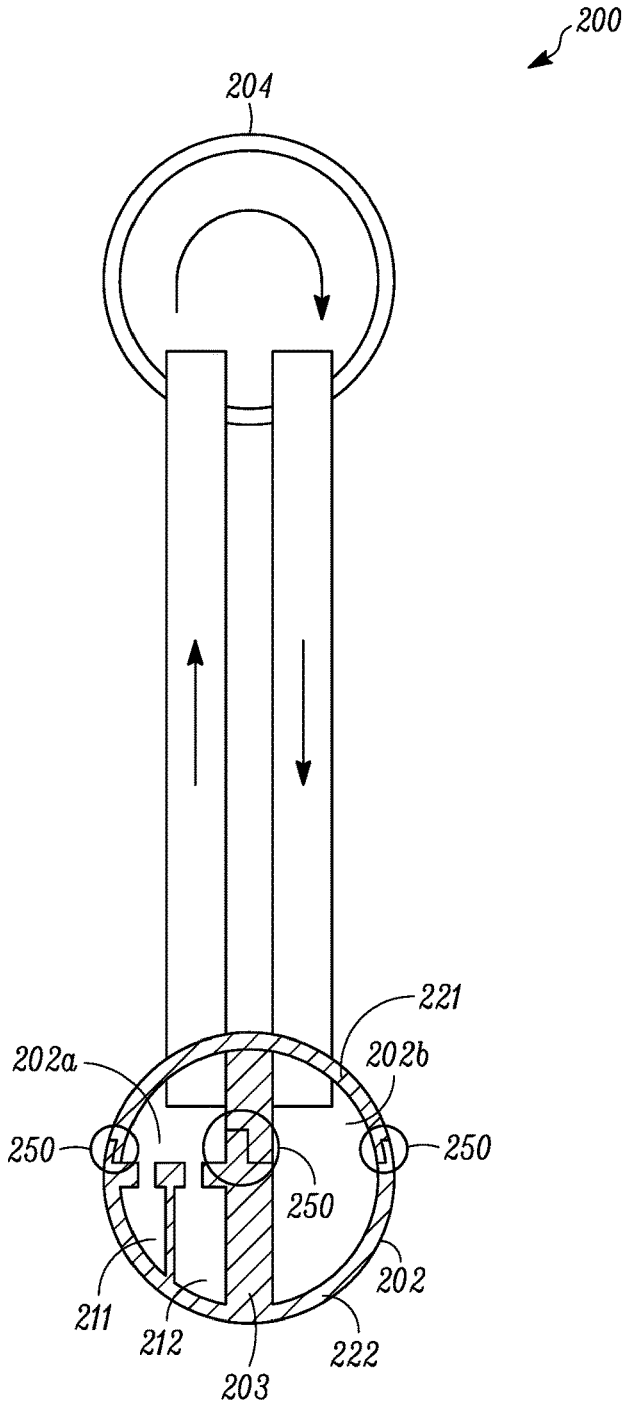
FIGS. 2A and 2B illustrate a heat exchanger according to another embodiment of this disclosure.
Figure 2B:
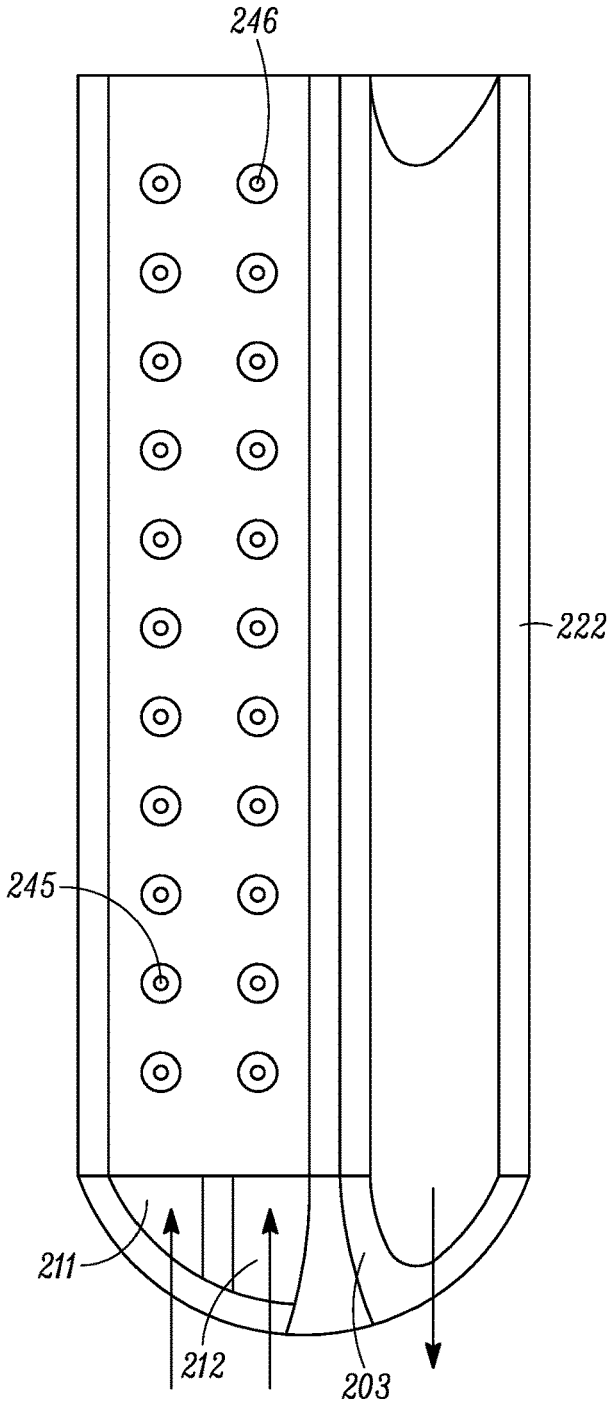

FIGS. 2A and 2B illustrate a heat exchanger 200 that includes two inlet compartments 211 and 212 in an inlet chamber 202*a*. In some embodiments, each of the two inlet compartments 211, 212 may be connected to a separate application circuit (not shown herein, e.g. a refrigeration circuit). Each of the separate application circuits, for example, may be configured to have a different capacity, allowing a greater capacity control.

The heat exchanger 200 illustrated herein includes a structure that generally resembles the embodiments as disclosed in FIGS. 1A and 1B, with the appreciation that the embodiments as disclosed herein may be applied to other suitable heat exchanger designs.

As illustrated, the heat exchanger 200 may include a first header 202 and a second header 204. The first header 202 is partitioned into the inlet chamber 202*a* and an outlet chamber 202*b* by a partition 203. It is to be appreciated that the embodiments as disclosed herein may be applied to a heat exchanger that does not have a partitioned header.

The inlet chamber 202*a* may include a plurality of inlet compartments, e.g. the first inlet compartment 211 and the second inlet compartment 212, with the appreciation that the inlet chamber 202*a* may include more than two inlet compartments. The plurality of inlet compartments 211 and 212 are configured to distribute a working fluid (e.g. a refrigerant) into the inlet chamber 202*a*. In some embodiments, each of the plurality of inlet compartments (e.g. the first inlet compartment 211 and the second inlet compartment 212) may be connected to separate application circuits (e.g. refrigeration circuit), so that the working fluid flow directed to each of the plurality of inlet compartments may be independently controlled.

As illustrated in FIG. 2B, the first inlet compartment 211 and the second inlet compartment 212 may each include at least one orifice 245 and 246 respectively, to meter a working fluid flowing through the orifices 245, 246. It is to be appreciated that the configurations (e.g. a total number, size, dimensions) of the orifices 245, 246 may be configured differently. In some embodiments, for example, when the first inlet 211 and the second inlet 212 may be connected to two refrigeration circuits with different capacities, the orifices 245, 246 may be configured to suitably match the capacity of the refrigeration circuit to which it is fluidly connected. That is, the total number, size, and/or dimensions of the orifices 245, 246 can be configured to achieve a desired performance of the connected refrigeration circuit.

In some embodiments, the first inlet compartment 211 and the second inlet compartment 212 may be connected to the same application circuit (e.g. a refrigeration circuit), but the working fluid flow directed into the first inlet compartment 211 and the second inlet compartment 212 may be independently controlled. The configurations of the orifices 245, 246 can also be different. These features can allow versatile control of the application circuit. For example, when one refrigeration circuit with a variable capacity is connected to the first inlet compartment 211 and the second inlet compartment 212 together, the refrigerant can be independently metered into the inlet compartments 211, 212, which can allow expansion of the refrigerant to be suitable for the operation mode of the refrigeration circuit (e.g. to achieve a desired performance in, for example, a partial load operation mode or a full load operation mode). In some embodiments, the independent control of the first inlet compartment 211 and the second inlet compartment 212 may be performed externally by, for example, one or more valves.

As illustrated in FIG. 2B, the orifices 245, 246 may be distributed axially through the first header 202, permitting efficient distribution of the working fluid and improving the overall heat transfer performance of the heat exchanger 200.

Referring to FIG. 2A, the first header 202 can be configured to have two separate extruded pieces 221 and 222, which form a clamshell configuration. The extruded pieces 221 and/or 222 may include the internal features (e.g. the orifices 245, 246 and the partition 203) of the header 202. The extrusion design allows flexibility in design and in a fabrication process for optimizing the heat exchanger performance and cost. The extrusion design may also allow different tubing, fin designs and row geometries to be incorporated. It is understood that in some embodiments, the first header 202 may include more than two separate extruded pieces.

The extruded pieces 221 and 222 may form one or more structural joints 250 to enhance the structural strength when the extruded pieces 221 and 222 are joined.

Generally, the extrusion design may include forming the header with two or more extruded pieces, each of which may include specific structural features. For example, one piece may include the partitioned configuration, and the other piece may function as a cap (e.g. as illustrated in FIG. 2A). The two extruded pieces may be joined through one or more joints to form the header.

Figure 3C:
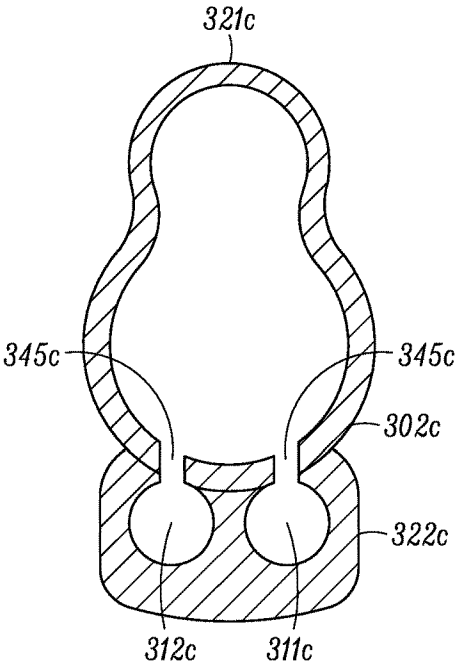
FIGS. 3A to 3C illustrate different embodiments of a header in a heat exchanger.
Figure 3B:
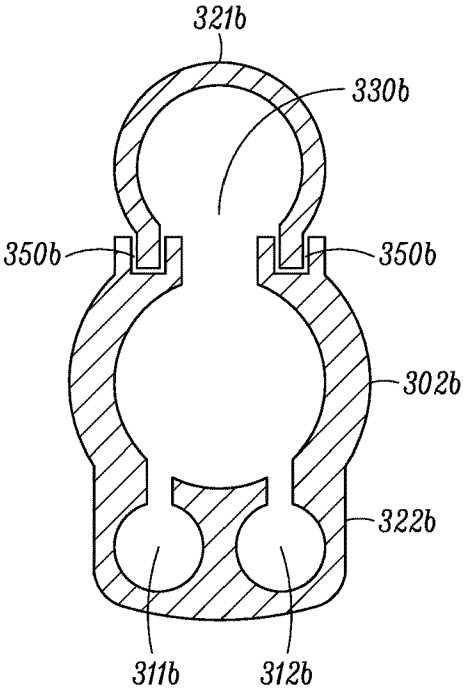
Figure 3A:
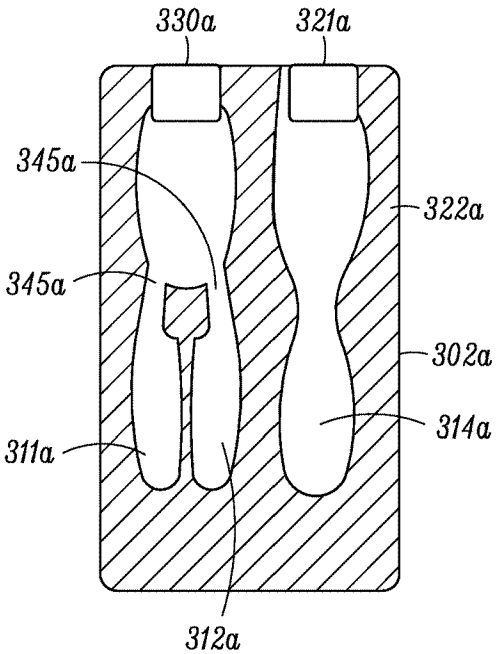

FIGS. 3A to 3C illustrate other embodiments of a header that may be formed by two or more pieces. In some embodiments, each of the pieces may be formed by an extrusion process. FIG. 3A illustrates a header 302*a* formed by a first piece 321*a* and a second piece 322*a*, where the second piece 322*a* is configured to include internal features, e.g. one or more orifices 345*a*, one or more inlets 311*a*, 312*a*, and an outlet 314*a*. The first piece 321*a* is fitted into an opening 330*a* of the second piece 322*a* to form the header 302*a*.

FIG. 3B illustrates a header 302*b* formed by a first piece 321*b* and a second piece 322*b*, where the second piece 322*b* is configured to include internal features, e.g. one or more orifices 345*b* and one or more inlets 311*b*, 312*b*. The first piece 321*b* is configured to cover an opening 330*b* of the second piece 322*b*, and is joined to the second piece 322*b* by one or more joints 350*b*. FIG. 3C illustrates a header 302*c* formed by a first piece 321*c* and a second piece 322*c*, where the second piece 322*c* may be attached to a bottom of the first piece 321*c*. It is noted that one or more orifices 345*c* may be formed on the bottom of the first piece 321*c*. The first piece 321*c* may include one or more inlets 311*c*, 312*c*. It will be appreciated that the headers 302*b*, 302*c* show the inlet structure, but may include an outlet structure similar to header 302*a*, which can be suitably incorporated as part of the second piece 322*b*, 322*c* respectively.

Figure 4:
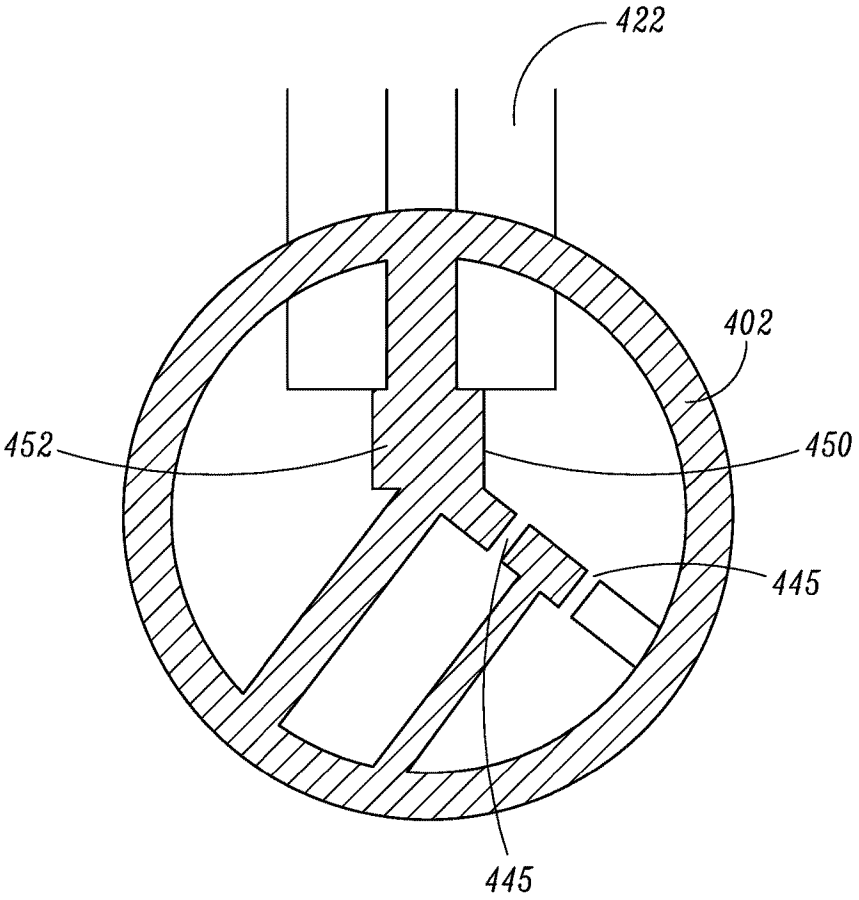
FIG. 4 illustrates another embodiment of a header in a heat exchanger.

FIG. 4 illustrates that internal features of a header 402 may include a stop section 450, which is configured to support a heat exchange tube 422 and prevent the heat exchange tube 422 from extending further into the header 402. The stop section 450 may include a shoulder 452 that is configured to be in contact with and support the heat exchange tube 422. It is noted that, as illustrated in FIG. 4, orifices 445 may be oriented diagonally relative to the heat exchange tube 422 in a heat exchange design.

Figure 5A:
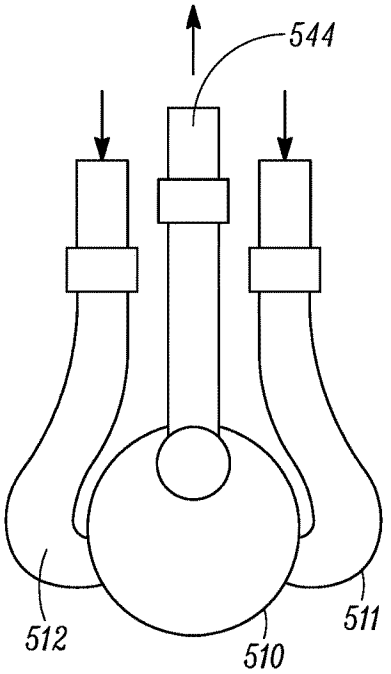
FIGS. 5A to 5C illustrate a header of a heat exchanger including one or more external inlets, according to one embodiment.
Figure 5B:
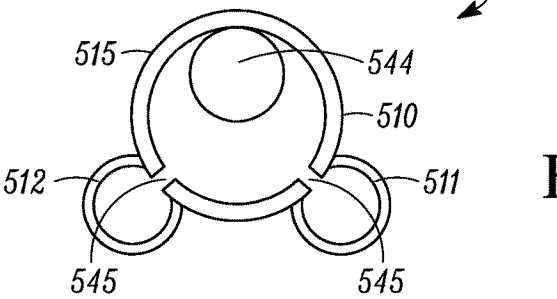
Figure 5C:
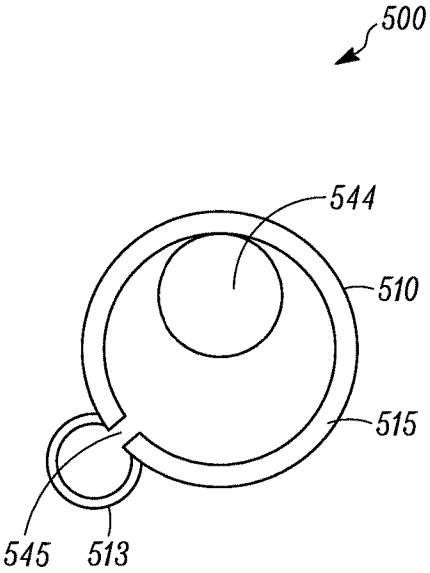

FIGS. 5A-5C illustrate another embodiment of a header 500 that incorporates one or more working fluid lines, e.g. first and second inlets 511, 512 in FIG. 5A or an inlet 513 in FIG. 5C, where the one or more working fluid lines are external to a main body 510 of the header 500. The main body 510 may include one or more orifices 545 on a shell 515 of the main body, through which fluid communication between the main body 510 and the first and second inlets 511, 512 or the inlet 513 can be formed.

The header 500 can also include an outlet 544 that is in fluid communication with the main body 510. In the illustrated embodiment, the outlet 544 is positioned internally in the main body 510, with the appreciation that the outlet 544 can also be positioned externally relative to the main body 510.

Figure 6A:
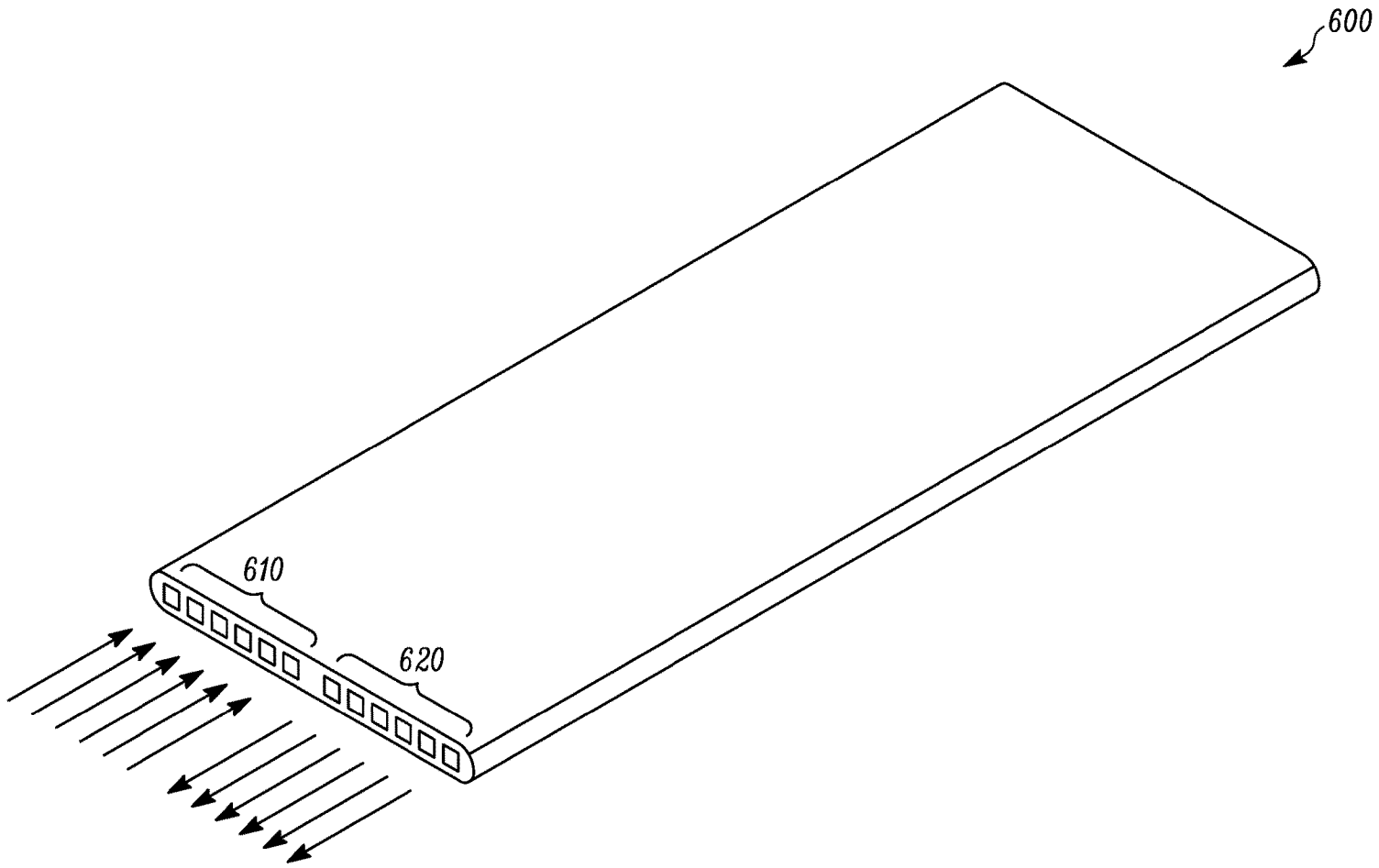
FIGS. 6A to 6D illustrate another embodiment of a heat exchange tube in a heat exchanger and a method of making.
Figure 6B:
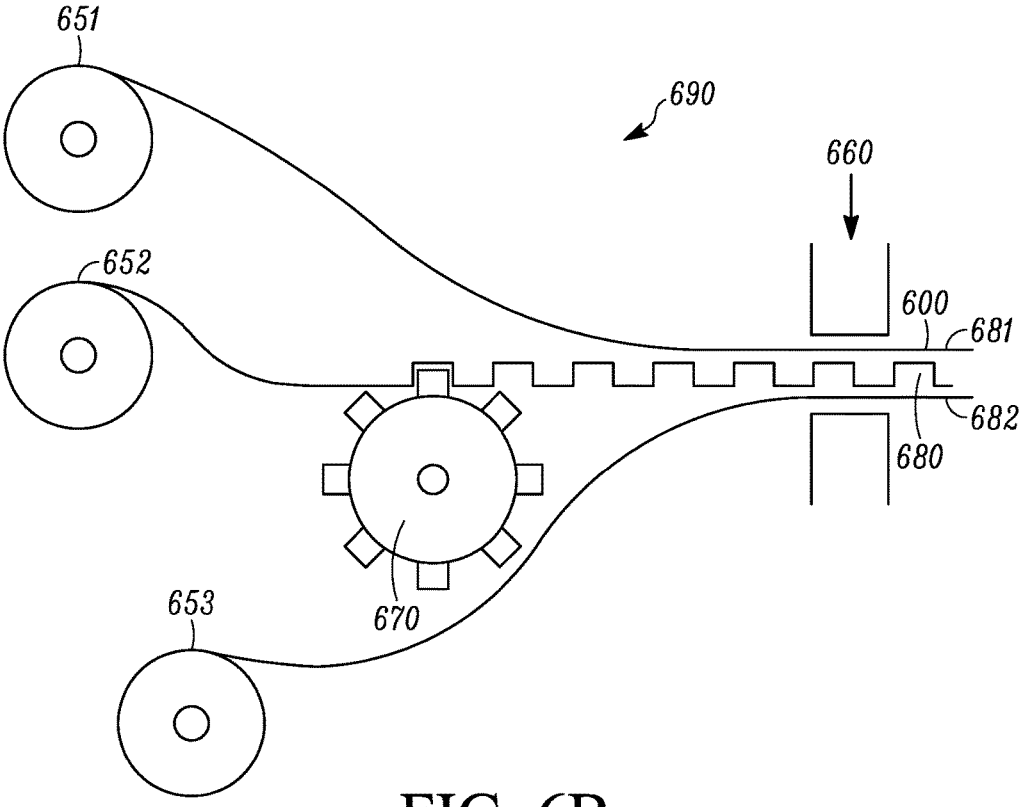
Figure 6C:
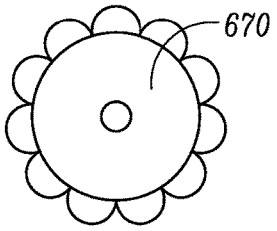

FIG. 6A illustrates a micro-channel heat exchange tube 600 that may include a plurality of first micro-channels 610 and a plurality of second micro-channels 620 that are configured to direct a working fluid (e.g. refrigerant) in different directions (illustrated by arrows). It is appreciated that the direction of the working fluid in the first micro-channels 610 and the second micro-channels 620 can be the same in some embodiments. FIGS. 6B and 6C illustrate an apparatus and a method to manufacturer the micro heat exchange tube 600 thereof.

The micro-channel heat exchange tube 600 may be used with, for example, the heat exchangers 100, 200 as illustrated in FIGS. 1A and 2A respectively, and with any of the headers herein. The first micro-channels 610 may form, for example, fluid communication with the inlet chamber 102*a*, 202*a*, to direct the working fluid in one direction, while the second micro-channels 620 may form, for example, fluid communication with the outlet chamber 102*b*, 202*b*, to direct the working fluid in another direction. This configuration allows relatively compact micro-channel heat exchange tube design.

The micro-channel heat exchange tube 600 may be made by a folding process. As illustrated in FIG. 6B, the folding process may be accomplished by a tube making system 690. The tube making system can provide three rolls of sheet materials: a first roll of sheet material 651, a second roll of sheet material 652 and a third roll of sheet material 653, which can be directed toward a folding apparatus 660 of the tube making system 690. In the folding apparatus 660, the three rolls of sheet materials 651, 652 and 653 may form a first side 681, micro-channels 680, and a second side 682 of the micro-channel heat exchange tube 600 respectively. The second roll of sheet material 652 may be shaped by a stamping apparatus 670 of the tube making system 690, which defines the micro-channels 680 in the micro-channel heat exchange tube 600 with the first and third rolls of sheet materials 651, 653.

The stamping apparatus 670 in FIG. 6B is configured to form micro-channels with a relatively square cross section. This is exemplary. As illustrated in FIG. 6C, the stamping apparatus 670 may be configured to have other configurations so as to form micro-channels with other configurations (e.g. cross section shapes, dimensions, space between neighboring micro-channels), which may allow the configurations of the micro-channels to be optimized, e.g. to increase a heat exchange efficiency of the heat exchange tubes. In some embodiments, for example, the cross section of the micro-channels may include, for example, chevrons.

The three rolls of sheet material 651, 652, and 653 may, for example, include different materials, or have different thickness, which allows design flexibility.

Figure 6D:
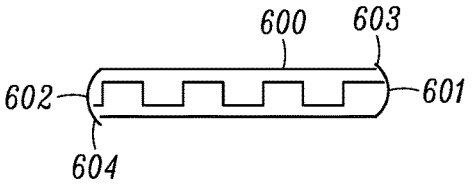

Referring to FIG. 6D, after the folding process as illustrated in FIG. 6B, a leading edge 601 and a trailing edge 602 of the heat exchange tube 600 may be wrapped to form first and second seam joints 603, 604. The seam joints 603, 604 can be sealed, for example, by a brazing process, such as an oven brazing process, with the understanding that other processes to seal the seam joints 603, 604 may also be used.

The folding process as illustrated may be cheaper than a traditional extrusion process to make heat exchange tubes.

Figure 7A:
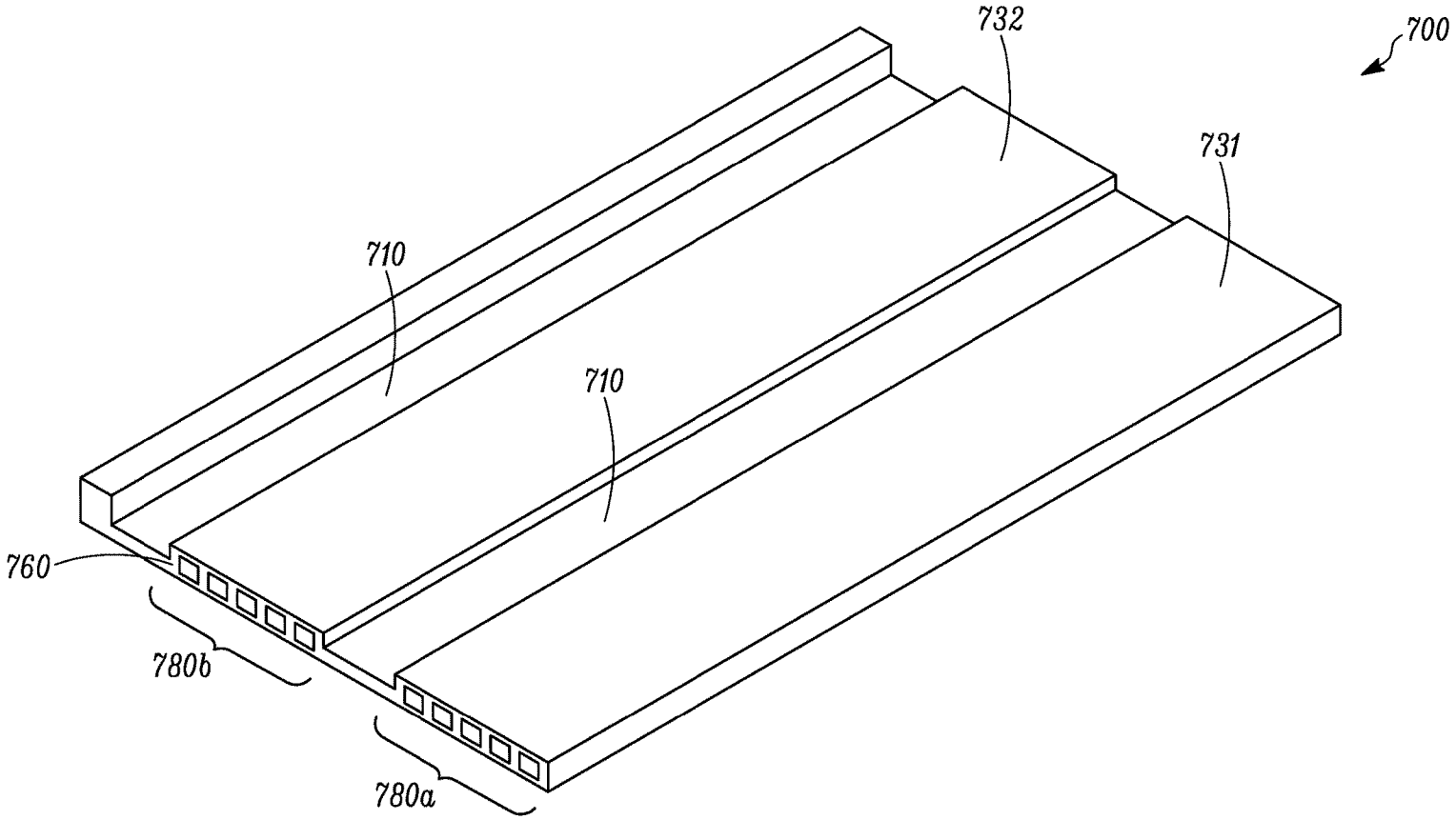
FIGS. 7A and 7B illustrate another embodiment of a heat exchange tube of a heat exchanger, according to yet another embodiment.
Figure 7B:
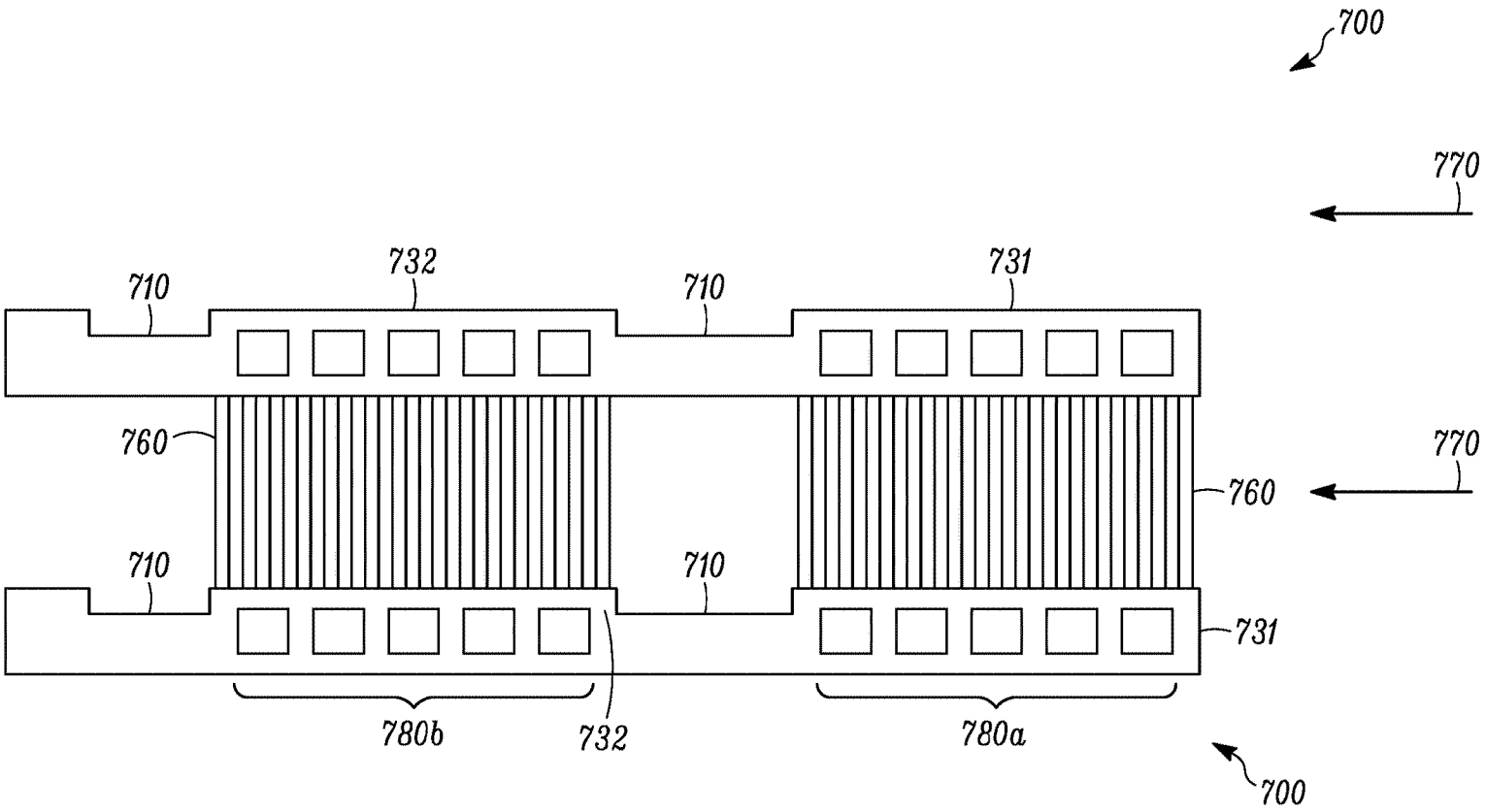

FIGS. 7A and 7B illustrate a heat exchange tube 700 that includes one or more condensate drainage channels 710, which are configured to collect condensate that may be formed, for example, on the heat exchange tube 700 during operation. As illustrated, the one or more condensate drainage channels 710 can be arranged between, for example, a first portion 731 including a first group of micro-channels 780*a* and a second portion 732 including a second group of micro-channels 780*b*. In some embodiments, the first group of micro-channels 780*a* and the second group of micro-channels 780*b* can be configured to direct a working fluid in different directions. The one or more condensate drainage channels 710 can also be arranged at an end 760 of the heat exchange tube 700. The condensate drainage channels 710 can extend in a direction that is parallel to the micro-channels 780*a*, 780*b*.

Referring to FIG. 7B, in a heat exchanger, the neighboring heat exchange tubes 700 may be connected by heat exchange fins 760. In operation, for example, when the heat exchanger is used as an evaporator in a HVAC system, the condensate drainage channels 710 can be positioned downstream of at least some of the micro-channels 780*a*, 780*b* relative to a direction of an airflow 770. Condensate formed on surfaces of the heat exchange tubes 700 and/or the heat exchange fins 760 and blown away by the airflow 770 may be collected in the condensate drainage channels 710, resulting less condensate in the airflow 770. The condensate collected in the condensate drainage channels 710 can be directed away from the heat exchange tubes 700 in the condensate drainage channels 710.

It is to be noted that features of the embodiments as disclosed herein can be combined and/or modified to satisfy, for example, different design requirements.

Figure 8A:
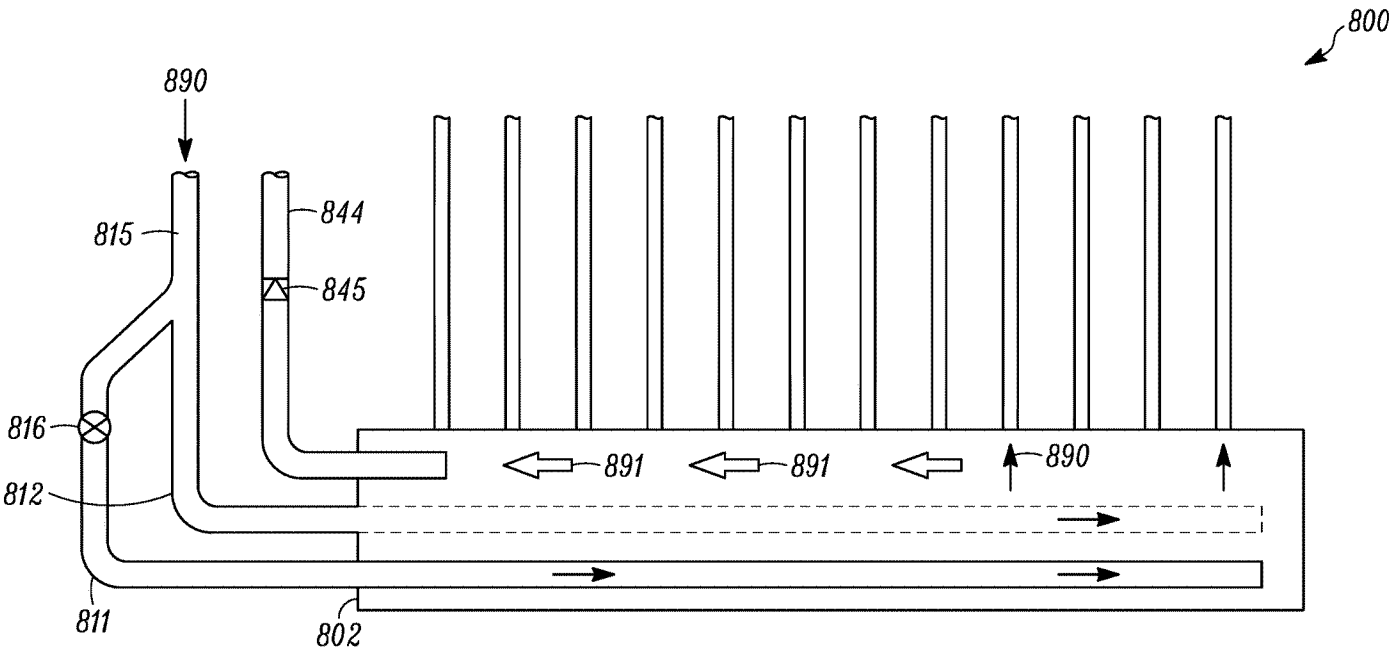
FIGS. 8A and 8B illustrate a capacity modulating heat exchanger according to another embodiment.
Figure 8B:
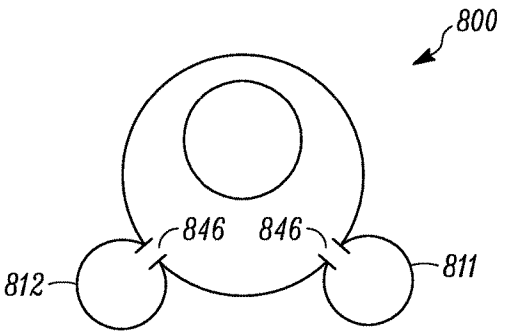

FIGS. 8A and 8B illustrate a capacity modulating heat exchanger 800 that incorporates embodiments as disclosed herein. Referring to FIGS. 8A and 8B together, the heat exchanger 800 has two inlets: a first inlet 811 and a second inlet 812 that form fluid communication with a header 802 through one or more orifices 846 (as illustrated in FIG. 8B).

In the illustrated embodiment, the heat exchanger 800 also includes an outlet 844 that forms fluid communication with the header 802.

A working fluid (e.g. refrigerant) may be directed into the first and second inlets 811, 812 through a common manifold 815. At least one of the first and second inlets 811, 812 may be connected to a flow control device (e.g. a flow control device 816, which is connected to the first inlet 811 in the illustrated embodiment) to control, for example, an amount of working fluid to get into the first and/or second inlets 811, 812. The working fluid 890 can then be metered by the orifices 846 when the working fluid 890 flows into the header 802 through the first and second inlets 811, 812. By regulating the amount of working fluid into at least one of the first and second inlets 811, 812, the amount of the working fluid 890 into the header 802, which can determine the capacity of the heat exchanger 800, can be regulated.

In some embodiments, as illustrated, the header 802 can form fluid communication with the outlet 844. The outlet 844 may include a flow control device 845 (e.g. a check valve). When, for example, the heat exchanger 800 works in a reverse mode (e.g. as illustrated by block arrows 891), a working fluid 890 may flow from the header 802 to the outlet 844 so as to leave the heat exchanger 800.

It is to be appreciated that in some embodiments, the heat exchanger 800 may include one inlet. In some embodiments, the heat exchanger 800 may include more than two inlets. In some embodiments, the first and second inlets 811, 812 may be independently connected to two separated circuits (e.g. two separated refrigeration circuits). The capacity of the heat exchanger 800 may be regulated by changing the performance of the circuits independently.

The heat exchangers as disclosed herein may be used, for example, as an evaporator and/or a condenser in a HVAC system, a refrigeration system, and/or a heat pump.

Figure 9A:
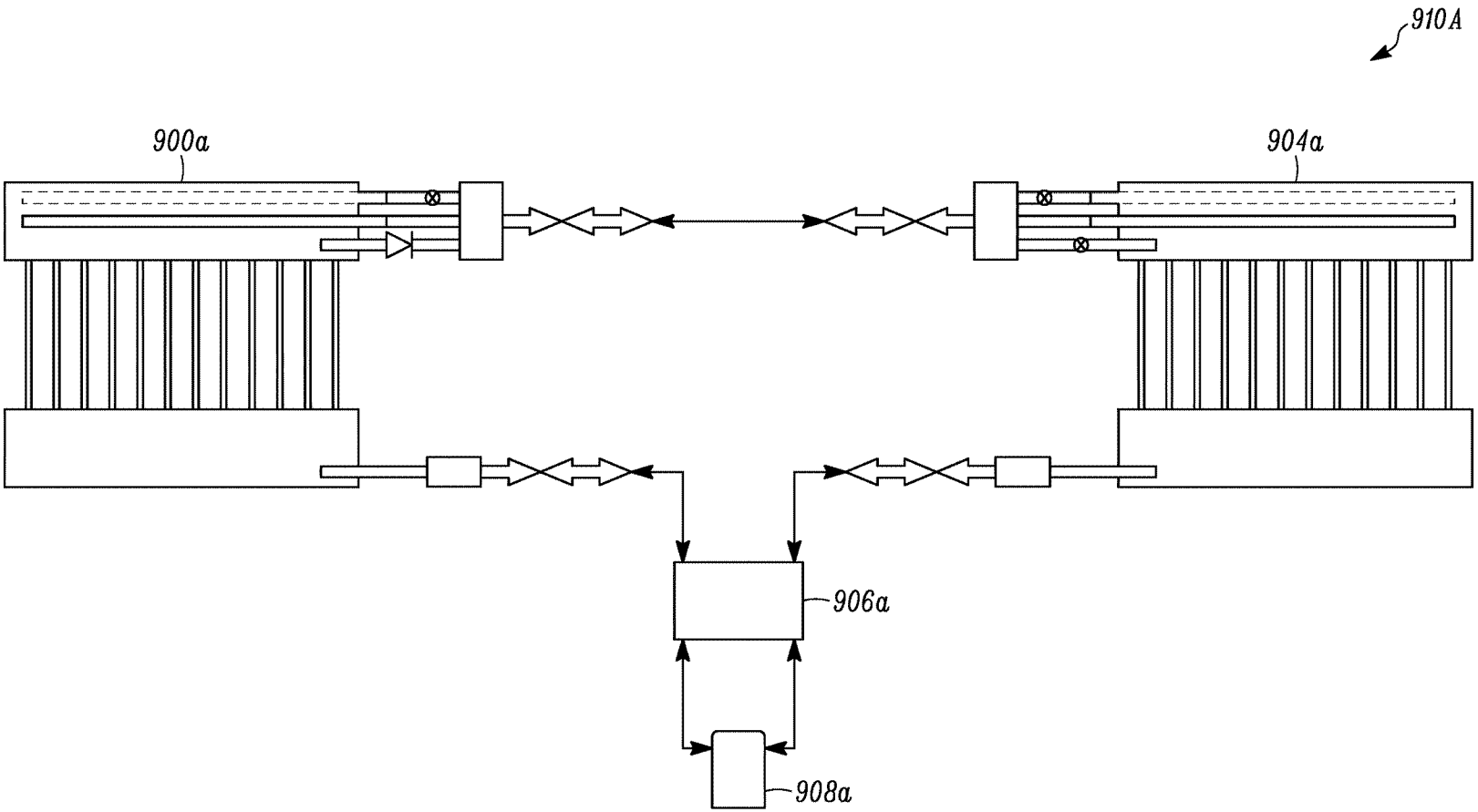
FIGS. 9A to 9C illustrate schematic diagrams of different embodiments of heat pumps, with which the heat exchanger as disclosed herein may be practiced.
Figure 9B:
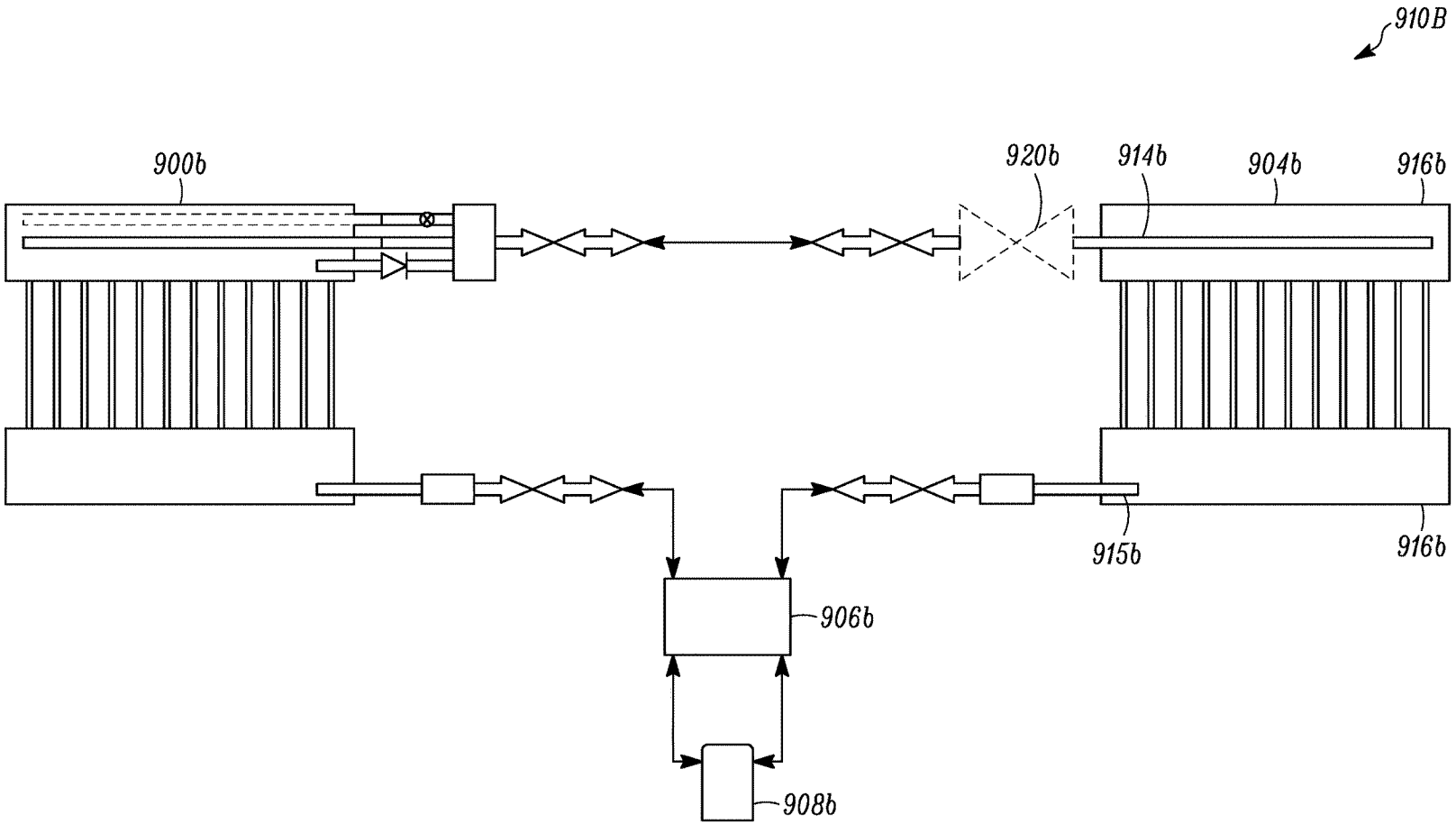
Figure 9C:
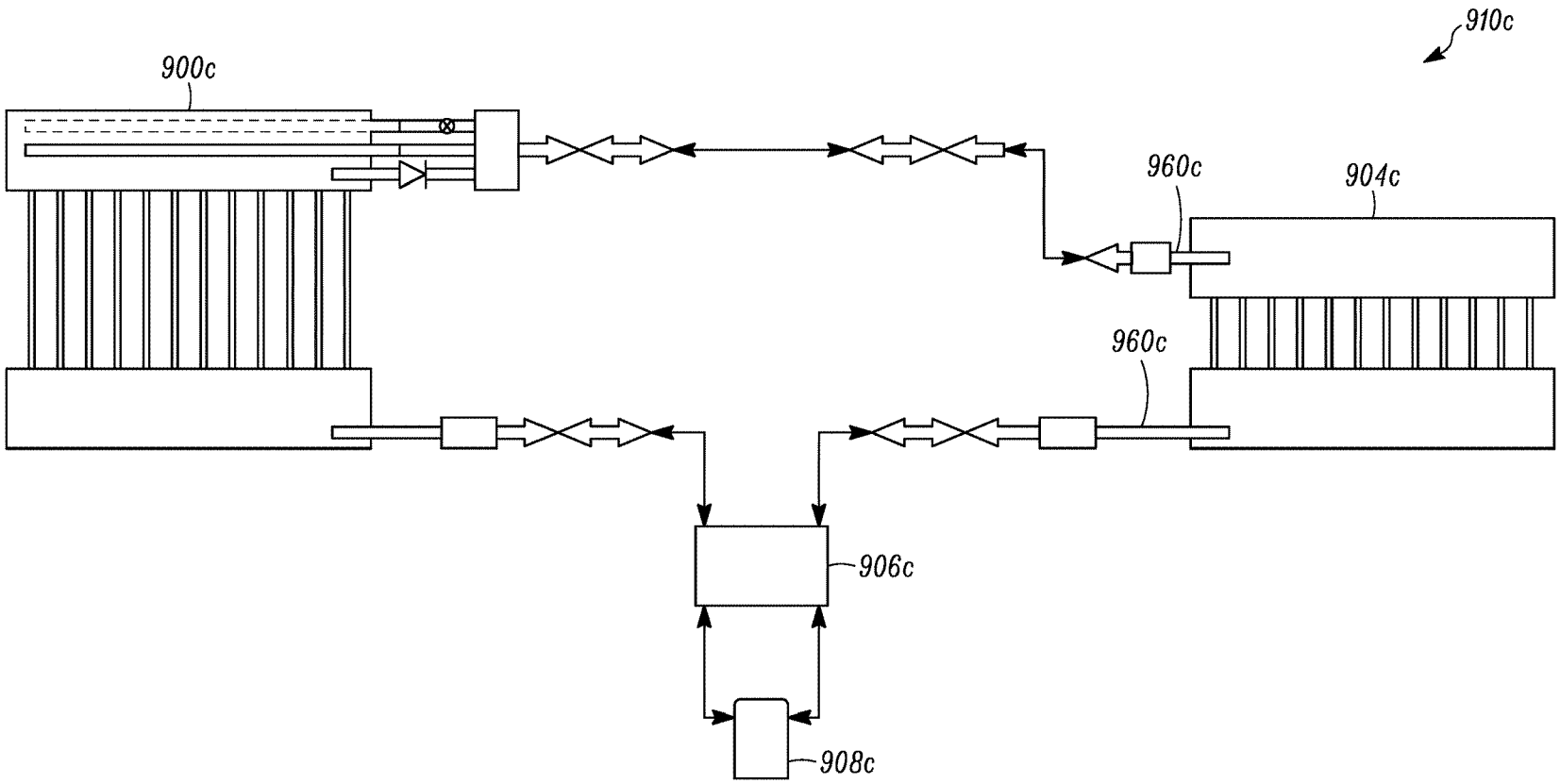

FIGS. 9A to 9C illustrate exemplary schematic diagrams of a heat pump circuit 910A to 910C that may use heat exchangers as disclosed herein. The heat pump circuit 910A to 910C generally includes an evaporator 900*a* to 900*c*, a condenser 904*a* to 904*a*, a compressor 908*a* to 908*c* and a flow reversing device (e.g. a four way valve) 906*a* to 906*c*.

As illustrated, the evaporators 900*a* to 900*c* can be a capacity modulating heat exchanger as illustrated in FIGS. 8A and 8B.

Referring to FIG. 9A, the condenser 904*a* can be a capacity modulating heat exchanger, such as for example as illustrated in FIGS. 8A and 8B.

Referring to FIG. 9B, the condenser 904*b* can be a heat exchanger with one inlet 914*b* and one outlet 915*b* that are in fluid communication with two different headers 916*b* respectively. The capacity of condenser 904*b* may be regulated by the inlet 914*b*, or optionally by an expansion device 920*b*.

Referring to FIG. 9C, the condenser 904*c* may be a co-axial heat exchanger. The co-axial heat exchanger 910*c* can be equipped with, for example, a short-orifice expansion device 960*c* (such as for example an orifice check valve). The expansion device 960*c* can be configured to allow the working fluid to free-flow in one direction, while expanding the working fluid in another direction.

It is to be appreciated that the embodiments as disclosed herein are exemplary. The heat exchangers as disclosed herein can be used with other types of heat exchangers and in other applications.

ASPECTS

Any of aspects 1-7 can be combined with any of aspects 8-18. Any of aspects 8-9 can be combined with any of aspects 10-18. Aspect 10 can be combined with any of aspects 11-18. Any of aspects 11-13 can be combined with any of aspects 14-18. Aspect 14 can be combined with any of aspects 15-18.

Aspect 1. A heat exchanger, comprising:
- a first header, the first header including a first chamber and a second chamber;
- a second header;
- a first heat exchange tube connecting the first chamber and the second header; and
- a second heat exchange tube connecting the second chamber and the second header.

Aspect 2. The heat exchanger of aspect 1, wherein a working fluid flow path is formed from the first chamber to the first heat exchange tube, then to the second header, and then to the second heat exchange tube.

Aspect 3. The heat exchanger of aspects 1-2, wherein the first chamber is configured to receive a working fluid, and the second chamber is configured to direct the working fluid out of the first header.

Aspect 4. The heat exchanger of aspects 1-3, wherein the heat exchanger is a micro-channel heat exchanger.

Aspect 5. The heat exchanger of aspects 1-4, wherein the first chamber is partitioned into at least two compartments, wherein each of the at least two compartments is configured to receive a working fluid.

Aspect 6. The heat exchanger of aspect 5, wherein one or more of the at least two compartments is configured to have at least one orifice to meter the working fluid.

Aspect 7. The heat exchanger of aspects 1-6, wherein the first header is formed by a first part and a second part.

Aspect 8. A heat exchanger, comprising:
- a first header;
- a working fluid line;
- a second header; and
- a heat exchange tube connecting the first header and the second header;
- wherein the working fluid line is connected to the first header externally.

Aspect 9. The heat exchanger of aspect 8, wherein the working fluid line is an inlet configured to receive a working fluid.

Aspect 10. A heat exchanger, comprising:
- a plurality of first tubes configured to direct a working fluid in a first direction; and
- a plurality of second tubes configured to direct the working fluid in a second direction.

Aspect 11. A heat exchanger, comprising:
- a fluid drainage channel at an end of the heat exchanger.

Aspect 12. The heat exchanger of aspect 11, further comprising:
- a second fluid drainage channel positioned between a first portion of the heat exchanger and a second portion of the heat exchanger.

Aspect 13. The heat exchanger of aspect 11, wherein the first portion of the heat exchanger includes a plurality of first heat exchange tubes directing a working fluid in a first direction, and the second portion of the heat exchanger includes a plurality of second heat exchange tubes directing the working fluid in a second direction.

Aspect 14. A refrigeration system, comprising:
- a first circuit;
- a second circuit; and
- a heat exchanger, wherein the heat exchanger includes:
  - a first inlet;
  - a second inlet; and
  - a header;

wherein the first inlet and second inlet are configured to direct a working fluid into the header, the first inlet is in fluid communication to receive refrigerant from the first refrigeration circuit, and the second inlet is in fluid communication to receive refrigerant from the second refrigeration circuit.

Aspect 15. A refrigeration system, comprising:

a heat exchanger, wherein the heat exchanger includes:

a first inlet;

a second inlet; and a header;

wherein the first inlet and second inlet are configured to direct a working fluid into the header, the first inlet is configured to include a flow control valve.

Aspect 16. The refrigeration system of aspect 15, wherein the heat exchanger is an evaporator of the refrigeration system.

Aspect 17. The refrigeration system of aspects 14-15, further comprising a second heat exchanger, wherein the second heat exchanger includes:

a first inlet;

a second inlet; and a header;

wherein the first inlet and second inlet are configured to direct a working fluid into the header, the first inlet is configured to include a flow control valve.

Aspect 18. The refrigeration system of aspect 17, wherein the second heat exchanger is a condenser of the refrigeration system.

With regard to the foregoing description, it is to be understood that changes may be made in detail, without departing from the scope of the present invention. It is intended that the specification and depicted embodiments be considered as exemplary only, with a true scope and spirit of the invention being indicated by the broad meaning of the claims.

The invention claimed is:

1. A heat exchanger, comprising:

a first header, the first header including a first chamber, a second chamber and a partition separating the first chamber and the second chamber, the first chamber having an inlet compartment;

a second header;

a plurality of first heat exchange tubes connecting the first chamber and the second header;

a plurality of second heat exchange tubes connecting the second chamber and the second header, the plurality of first heat exchange tubes and the plurality of second heat exchange tubes are microchannel heat exchange tubes;

a first inlet;

a second inlet; and an outlet in fluid communication with the second chamber;

wherein the first inlet is in fluid communication with a continuous internal volume within the inlet compartment of the first chamber via a plurality of first metering orifices, and the second inlet is in fluid communication with the same continuous internal volume within the inlet compartment of the first chamber via a plurality of second metering orifices.

2. The heat exchanger of claim 1, wherein a working fluid flow path is formed from the first chamber to the plurality of first heat exchange tubes, then to the second header, then to the plurality of second heat exchange tubes, and then through the outlet.

3. The heat exchanger of claim 1, wherein the first chamber is configured to receive a working fluid, and the second chamber is configured to direct the working fluid out of the first header.

4. The heat exchanger of claim 1, wherein the first chamber is partitioned into at least two compartments each in fluid communication with the inlet compartment of the first chamber, wherein each of the at least two compartments is configured to receive a working fluid, where the first inlet is in fluid communication with a first one of the compartments and the second inlet is in fluid communication with a second one of the compartments.

5. The heat exchanger of claim 4, wherein the first header is formed by a first part and a second part.

6. The heat exchanger of claim 4, further comprising a working fluid line, the working fluid line is externally connected to one of the first and second inlets of the first header and in fluid communication with the first chamber.

7. The heat exchanger of claim 6, wherein the working fluid line is in fluid communication with the one of the first and second inlets of the first header and is configured to receive a working fluid.

8. The heat exchanger of claim 4, wherein one or more of the tubes of the plurality of first heat exchange tubes and one or more of the tubes of the plurality of second heat exchange tubes are configured as a combined tube construction to direct a working fluid in a first direction and to direct the working fluid in a second direction.

9. The heat exchanger of claim 8, wherein in the combined tube construction a fluid drainage channel is included at an end thereof, or therebetween, or both at an end thereof and therebetween.

10. The heat exchanger of claim 1, wherein the plurality of first metering orifices is distributed longitudinally over the entire length of the inlet compartment and the plurality of second metering orifices is distributed longitudinally over the entire length of the inlet compartment.

11. A refrigeration system, comprising:

a) a compressor;

b) a first heat exchanger in fluid communication with the compressor, the first heat exchanger including a first header, the first header including a first chamber, a second chamber and a partition separating the first chamber and the second chamber, the first chamber having an inlet compartment, a second header, a plurality of first heat exchange tubes connecting the first chamber and the second header, a plurality of second heat exchange tubes connecting the second chamber and the second header, the plurality of first heat exchange tubes and the plurality of second heat exchange tubes are microchannel heat exchange tubes, a first inlet in fluid communication with the first chamber, a second inlet in fluid communication with the first chamber, the first inlet is configured to direct a first working fluid into a continuous internal volume within the inlet compartment of the first chamber of the first header through a plurality of first metering orifices, and the second inlet is configured to direct a second working fluid into the same continuous internal volume within the inlet compartment of the first chamber through a plurality of second metering orifices, an outlet in fluid communication with the second chamber; and c) a second heat exchanger in fluid communication with the compressor, and the second heat exchanger in fluid communication with the first heat exchanger.

12. The refrigeration system of claim 11, wherein the first inlet of the first heat exchanger comprises a flow control valve.

13. The refrigeration system of claim 11, wherein the first heat exchanger is an evaporator of the refrigeration system.

14. The refrigeration system of claim 11, wherein the second heat exchanger includes a first inlet, a second inlet, and a header, wherein the first inlet and the second inlet of the second heat exchanger are configured to direct the first and second working fluids into the header of the second heat exchanger, and the first inlet of the second heat exchanger comprises a flow control valve.

15. The refrigeration system of claim 11, wherein the second heat exchanger is a condenser of the refrigeration system.

16. The refrigeration system of claim 11, further comprising a flow reversing device in fluid communication with the compressor.

17. The refrigeration system of claim 11, wherein the refrigeration system is a heat pump.

18. The refrigeration system of claim 11, wherein the first inlet of the first heat exchanger is in fluid communication with a first refrigeration circuit, and the second inlet of the first heat exchanger is in fluid communication with a second refrigeration circuit.

19. The refrigeration system of claim 11, wherein the plurality of first metering orifices is distributed longitudinally over the entire length of the inlet compartment and the plurality of second metering orifices is distributed longitudinally over the entire length of the inlet compartment.

* * * * *